United States Patent [19]

Greenawalt

[11] Patent Number: 4,501,034

[45] Date of Patent: Feb. 26, 1985

[54] INFLATABLE PILLOW

[76] Inventor: Monte H. Greenawalt, 45 McClellan Blvd., Davenport, Iowa 52803

[21] Appl. No.: 546,248

[22] Filed: Oct. 27, 1983

[51] Int. Cl.[3] ..... A47G 9/00

[52] U.S. Cl. ..... 5/441; 5/434

[58] Field of Search ..... 5/441, 455, 454, 434, 5/436, 440, 435

[56] References Cited

U.S. PATENT DOCUMENTS

| | | | |
|---|---|---|---|
| 655,087 | 7/1900 | Jones | 5/441 |
| 2,880,428 | 4/1959 | Forsland | 5/441 |
| 3,411,164 | 4/1968 | Sumergrade | 5/441 |
| 3,521,310 | 7/1970 | Greenawalt | 5/436 |
| 3,757,364 | 9/1973 | Downing | 5/436 |

FOREIGN PATENT DOCUMENTS

| | | | |
|---|---|---|---|
| 2409326 | 9/1975 | Fed. Rep. of Germany | 5/436 |

*Primary Examiner*—Alexander Grosz

*Attorney, Agent, or Firm*—Henderson & Sturm

[57] ABSTRACT

A composite pillow of the type including one or more elements for receiving the neck or cervical region of a person lying on the pillow and another, adjacent element for receiving the person's head or occipital region, the purpose being to support the neck and head in the position occupied when the person is errect. The neck-receiving is of greater firmness than the adjoining element. In this invention, the neck-receiving element is made up of at least two end-to-end sections, one of firmness as aforesaid and the other containing a compartment enclosing an air bag which is selectively inflatable to vary the firmness of that section relative to the remainder of the pillow, thus enabling the pillow to contribute, for example, to the solution or at least alleviation of several temporary posture abnormalities suffered by the using person. In a modified form, the adjacent element of the pillow also has an air bladder therewithin which may be selectively inflated to further contribute to the ultimate comfort and/or cure of the user.

3 Claims, 8 Drawing Figures

INFLATABLE PILLOW

BACKGROUND AND BRIEF DESCRIPTION OF THE INVENTION

Greenawalt's U.S. Pat. No. 3,521,310 discloses a composite pillow having laminated elements of different firmness, at least one relatively firm element for receiving the back of the neck of a supine person and a relatively softer adjacent element for receiving that person's occipital region. The patent also contains reference to the prior U.S. Pat. Nos. to Jones 655,087 and Forsland 2,880,428 as examples of variations of pillows for improving the comfort of the user, especially when the user is suffering from, say, a posture abnormality.

Although the Greenawalt pillow has achieved wide acceptance in its field, there is room for further improvement, and such improvement is the basis of the present invention. Fundamentally, this invention adds at least another dimension to the Greenawalt pillow by providing variability of a portion of one of the elements of greater firmness, thus yielding a pillow in which, for example, a central portion of the firmer element may be made less firm or more firm, depending upon the condition of the user, whereby the user, when turning from side to side will encounter portions flanking the central portion that are of different firmness than the central portion. Experience has shown that great benefits flow from a construction of this type, enabling the pillow to accommodate itself to conditions in which the person's condition requires one type of support for the supine position and a different type when the person's head is turned as when the person lies on one side.

The above result is achieved in one form of the invention by providing the one element with a central section, for example, including a compartment in which an inflatable bladder is disposed. This bladder is selectively inflatable to achieve a variety of firmness conditions relative to the flanking portions or sections which may remain of constant firmness, being formed, typically, of foamed urethane or its equivalent. The central element of a three-element pillow as in the Greenawalt patent identified above, may be of a relative soft density, or substantially less firm than the portions flanking the bladder. The bladder may be inflated to be harder or softer than its flanking portions. In another form of the invention, the central element may have a bladder also selectively inflatable, thus increasing the flexibility of the pillow. Further features and advantages will occur as preferred embodiments of the invention are disclosed herein.

DETAILED DESCRIPTION OF PREFERRED FORMS OF THE INVENTION

Figure 1:
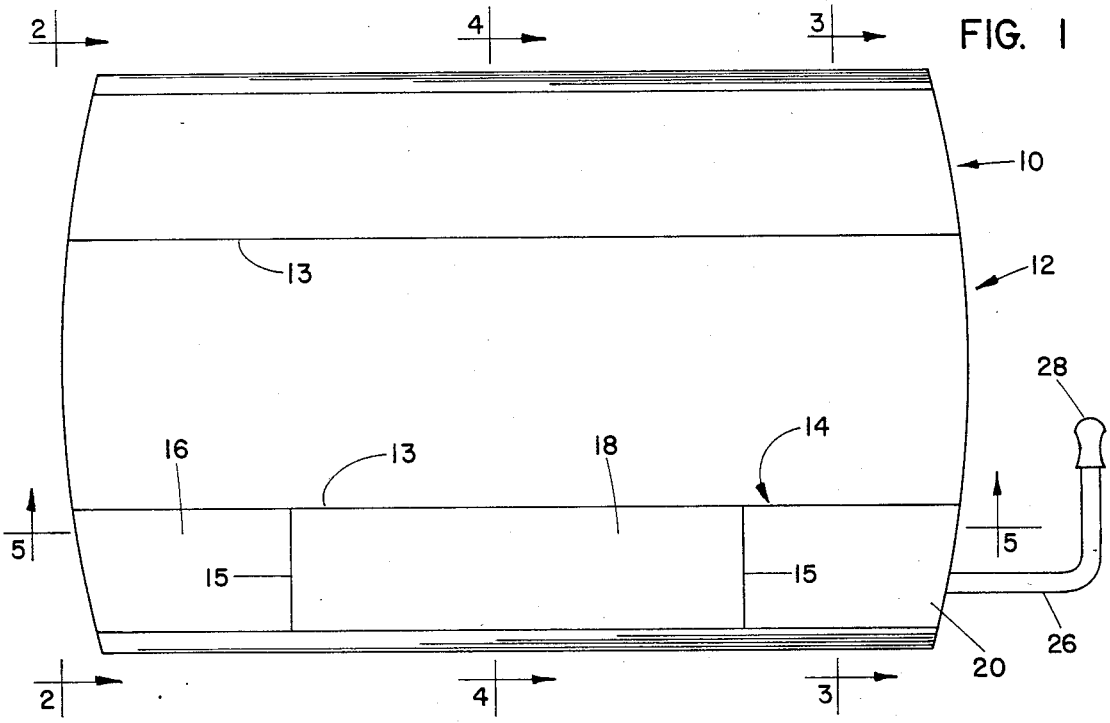
FIG. 1 is a plan view of a pillow incorporating the broad principles of the invention.
Figure 2:
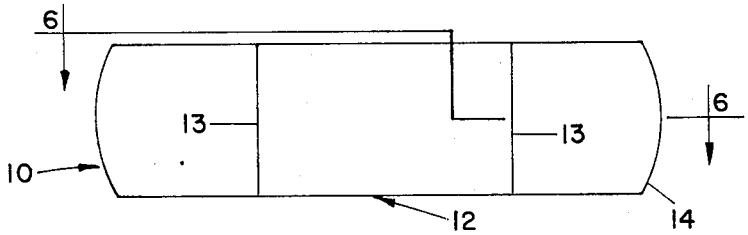
FIG. 2 is an end view as seen along the line 2—2 of FIG. 1.
Figure 3:
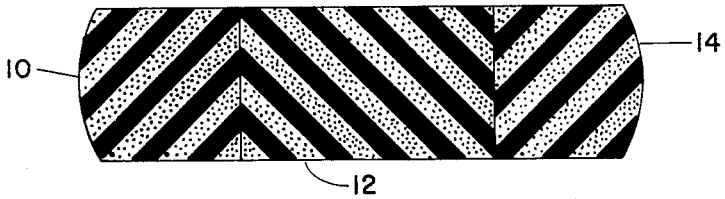
FIG. 3 is a section on the line 3—3 of FIG. 1.
Figure 4:
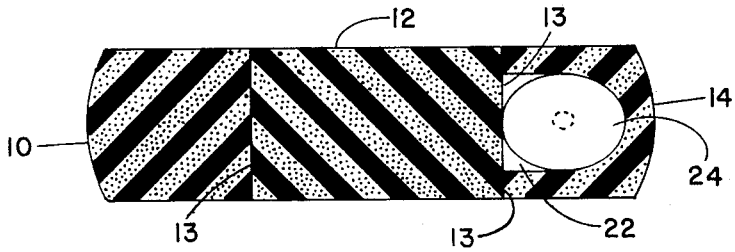
FIG. 4 is a section along the line 4—4 of FIG. 1.
Figure 5:
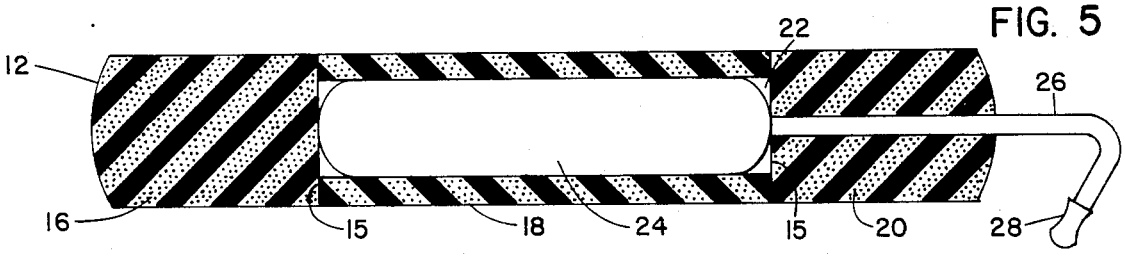
FIG. 5 is a section along the line 5—5 of FIG. 1.
Figure 6:
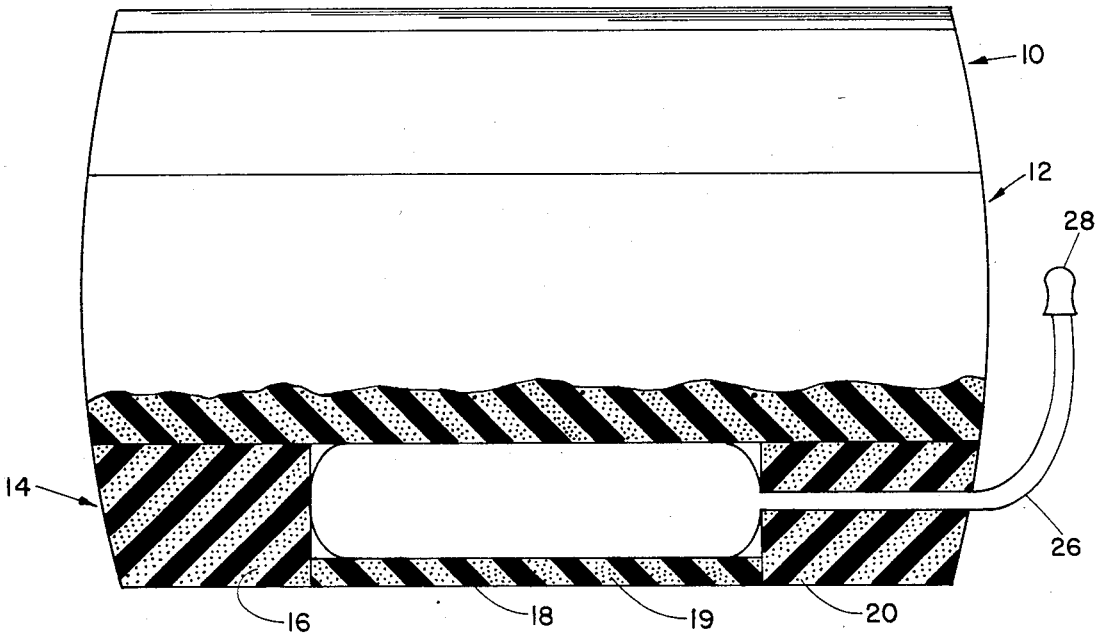
FIG. 6 is a section as seen along the line 6—6 of FIG. 2.

The drawings illustrate the pillows without the usual fabric covering, which is omitted here as inconsequential. The pillow of FIGS. 1–6 may be regarded as a composite made up of three basic elements (10), (12) and (14), all adhered or laminated together in any known fashion, as at junctures (13) and (15), so as to form an essentially rectangular product, which may be on the order of twenty-four inches long and fourteen to fifteen inches wide, with a height or thickness of four inches; although, these dimensions may be varied without losing the effectiveness of the basic principles of the invention. As distinguished from the Greenawalt patent, the element (14) is formed of three end-to-end sections (16), (18) and (20). The sections (16) and (20) are, like the element (10), formed of material of substantial firmness but the central section (18) is hollow or compartmented at (22) and contains an inflatable air bladder (24) having an inflating tube (26) projecting through and externally of the adjacent section (20) of the element (14). This tube is provided at its outer end with a valved mouthpiece (28) by means of which the bladder may be selectively inflated and deflated. The type of inflating means is not material to the invention.

From the description thus far it will be seen that the pillow has several areas of preselected firmness; for example, the element (10) and sections (16) and (20) of the element (14) may be of the same relative firmness, compared to which the central element (12) is relatively soft. Optionally, the element (10) may be of greater firmness than the end sections of element (14) or vice versa. The degree of firmness of the center section (18) of the element (14) may, because of its air bladder (24), be varied from a degree greater or lesser than the element (10) or the end sections of the element (14), thus providing a pillow of substantially increased versatility.

Figure 7:
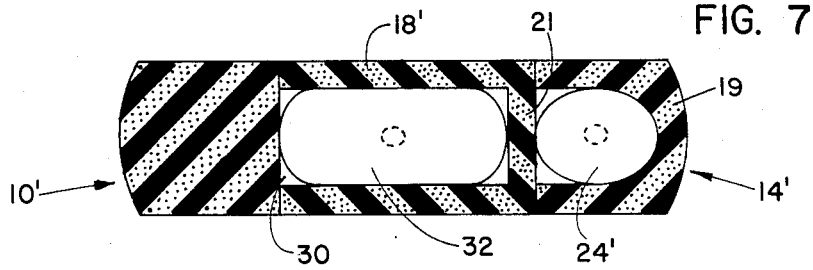
FIG. 7 is a section similar to FIG. 4 but showing a two-bladder modification.
Figure 8:
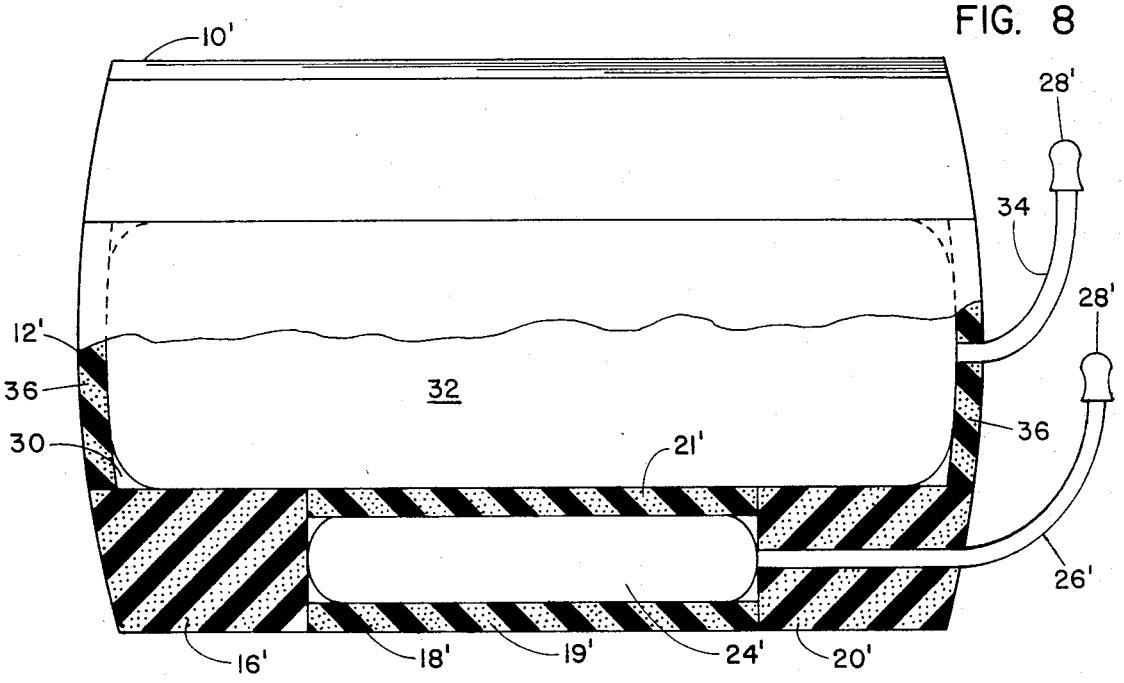
FIG. 8 is a section similar to FIG. 6 but showing the modified form of FIG. 7.

In the modified form of the invention depicted in FIGS. 7 and 8, the pillow may have the same overall dimensions, etc. as the pillow forming the subject matter of FIGS. 1–6. For the purpose of facilitating the description, some of basic reference numerals used earlier are repeated but primed in FIGS. 7 and 8. For example, the modified pillow has the laminated-together elements (10′), (12′) and (14′) and the element (14′) has the three end-to-end sections (16′), (18′) and (20′), with the center section containing an air bladder (24′) serviced by a tube (26′) and valved mouthpiece (28′). Here, as in the pillow described before, the three sections of the element (14) or (14′) may be varied as to length relative to each other and to the total length of the pillow so that the center section (18) or (18′) may be on the order of one-third to one-half of the total length of the pillow. The difference between the two pillows is that the FIGS. 7 and 8 pillow has its central element compartmented at (30) and fitted with a second air bladder (32) serviced by a valved tube (34). This construction increases the possibilities of firmness variation.

In providing for the air bladder compartments, resort has been had to suitable wall portions, as at (19) and (21) in FIGS. 1–6 and as at (19′), (21′) and (36) in FIGS. 7 and 8. These are secured in place in any known manner, preferably using known adhesives or equivalent procedures.

In both forms of the invention, the versatility of the pillow is enhanced, giving the user several options according to what is prescribed for his comfort, or cure in the event of a curable abnormality. Both pillows are simply constructed and thus can be easily manufactured and made available to consumers at relatively low cost. Features and advantages not specifically pointed out will become apparent to those versed in the art, as will many modifications in the preferred embodiments disclosed, all without departing from the spirit and scope of the invention.

I claim:

1. A pillow of the class described, comprising first and second, elongated side-by-side elements substantially coextensive in length and adhered together to present a composite body having upper and lower surfaces, the first element upper surface being adapted to receive the neck of a reclining person and the upper surface of the second element being adapted to receive the head of such reclining person, said first element including first and second end-to-end sections, said first section being made up of relatively dense yieldable material of preselected firmness substantially throughout its length, said second section including a compartment therein exclusive of the first section, an air bladder contained within said compartment and selectively inflatable to vary the firmness of the upper surface of the second section relative to the firmness of the first section, said second element including a compartment with a second air bladder being selectably inflatable to vary the firmness of the second element, and said second element being inflated as to possess, throughout its length, less firmness than the first section and less firmness than the second section when the bladder is inflated to a degree equal to or exceeding the firmness of the first section, said pillow including a third element flanking and adhered to the second element at the side thereof opposite to the first element, said third element being so constructed as to possess substantially the firmness of the first section of the first element.

2. The pillow of claim 1, further including a third section similar to the first section as to density and disposed in such end-to-end relationship to the second section that the second section lies intermediate the first and third sections.

3. The pillow of claim 2, in which the length of the second section with respect to the total length of the first element is on the order of one-third to one-half said total length.

* * * * *